US006733002B1

(12) United States Patent
de Maussion et al.

(10) Patent No.: US 6,733,002 B1
(45) Date of Patent: May 11, 2004

(54) CRASH BARRIER FOR HIGHWAY OR THE LIKE COMPRISING WOODEN FIBER-REINFORCED RAILS

(76) Inventors: Jacques de Maussion, Les Bois de Tertu, Domaine de Tertu, 61160 Villedieu Les Bailleul (FR); Jean-Luc Sandoz, Chernin de la Brume No. 4, 1110 Morges (Vaud) (CH)

( * ) Notice: Subject to any disclaimer, the term of this patent is extended or adjusted under 35 U.S.C. 154(b) by 0 days.

(21) Appl. No.: 10/031,606

(22) PCT Filed: Jul. 21, 2000

(86) PCT No.: PCT/FR00/02119

§ 371 (c)(1),
(2), (4) Date: Jul. 17, 2002

(87) PCT Pub. No.: WO01/07718

PCT Pub. Date: Feb. 1, 2001

(30) Foreign Application Priority Data

Jul. 22, 1999 (FR) ..... 99 09541

(51) Int. Cl.[7] ..... E01F 15/04
(52) U.S. Cl. ..... 256/13.1; 256/19; 404/6
(58) Field of Search ..... 256/13.1, 19; 404/6, 404/7, 8, 9

(56) References Cited

U.S. PATENT DOCUMENTS

| | | | | |
|---|---|---|---|---|
| 3,695,583 A | * | 10/1972 | Walker et al. | 256/13.1 |
| 3,768,781 A | * | 10/1973 | Walker et al. | 256/13.1 |
| 4,982,931 A | * | 1/1991 | Pomero | 256/13.1 |
| 5,169,127 A | * | 12/1992 | Eynard | 256/13.1 |
| 5,402,987 A | * | 4/1995 | Duyck et al. | 256/13.1 |
| 5,462,258 A | * | 10/1995 | Gaillard et al. | 256/13.1 |

FOREIGN PATENT DOCUMENTS

| | | | | |
|---|---|---|---|---|
| DE | 94 95 557 | | 7/1994 | |
| DE | 197 19 594 | | 5/1998 | |
| EP | 540 012 | | 5/1993 | |
| EP | 924 346 | | 6/1999 | |
| FR | 2633319 | * | 6/1988 | 256/13.1 |
| FR | 2690937 | * | 5/1992 | 256/13.1 |
| FR | 2694028 | * | 7/1992 | 256/13.1 |
| FR | 2 718 473 | | 10/1995 | |
| FR | 2 723 755 | | 2/1996 | |
| FR | 2770236 | * | 10/1997 | 256/13.1 |

* cited by examiner

*Primary Examiner*—Frederick L. Lagman
(74) *Attorney, Agent, or Firm*—Leydig, Voit & Mayer, Ltd.

(57) ABSTRACT

The invention concerns a safety barrier for highways or the like, including rails in abutted assembly and fixed on posts spaced apart and driven into the ground. At least one rail of the barrier is made of wood and has synthetic fibers fixed on at least a rear part of the rail, extending over substantially the entire length of the rail.

12 Claims, 2 Drawing Sheets

CRASH BARRIER FOR HIGHWAY OR THE LIKE COMPRISING WOODEN FIBER-REINFORCED RAILS

FIELD OF THE INVENTION

The invention concerns a crash barrier designed as equipment for highways or any other traffic routes to protect vehicles that are driven on them from the risk of a possibly dangerous highway exit.

More precisely, the invention concerns a crash barrier of the type that comprises posts driven into the ground and spaced apart from each other, and wooden rails connected end-to-end with each other and fixed on the posts so that they connect between them, each rail presenting a longitudinal axis with wooden fibers oriented along the longitudinal axis, a front external surface turned toward the highway and a rear external surface turned towards the posts and being substantially reinforced along its length by synthetic fibers forming at least a first cover that extends parallel to the longitudinal axis.

BACKGROUND

More generally, the crash barriers conventionally used are composed of several rails connected end-to-end to form a continuous and approximately horizontal part, these rails being fixed by bolts to posts which are spaced apart and driven into the ground.

These barriers most often include metallic rails, wooden rails or even wooden rails reinforced by a metal part.

In the case of a vehicle impacting the barrier, the role of the barrier is first to absorb the dynamic energy of the vehicle to prevent the latter from rebounding violently onto the highway or even being quite damaged.

This energy is essentially absorbed by posts that became deformed if they are metallic or which break if they are wooden.

Moreover, the approximately horizontal continuous part formed by the rails should not be totally broken, even at the point of impact of the vehicle on the barrier. This part tightens as soon as the posts are deformed, but remains intact, to enable the vehicle that has left the highway to be progressively brought back to it while stopping it from falling down a highway embankment or even into a ravine.

Barriers comprising wooden rails present numerous advantages but also several defects that need to be corrected.

In fact, wood is a material that has a fragile elastic behavior in tension and plastic elastic behavior in compression. The impact of the vehicle on the barrier is expressed by a tensile force in the rails on the side opposite the impact.

Under these stress conditions, the tension zone ruptures and, by propagation of the cracks, may cross the rail(s) concerned and break them completely. Even pinewood, in which the plastification phase is relatively high, does not guarantee the integrity of the barrier in case of impact.

That is why barriers, including wooden rails, are traditionally best used on highways where the impact is low, for example, on mountain roads or on portions of the highway on which vehicles are only allowed to travel at a much reduced speed.

Reinforcement of wooden rails has already been proposed, using metallic fittings integrated in the rear of the rails, that is, on the side of the posts. Reference may especially be made to the document FR-2 717 196.

Subject to presenting sufficient and well-conceived reinforcement, such barriers can ensure the same safety conditions as metal barriers, while being more friendly to the environment. They therefore provide full satisfaction.

However, they include the drawback of being relatively heavy because of the presence of metallic reinforcement parts, which poses problems during transport and installation of the barriers. The cost of these barriers is also relatively high.

The German utility model DE-G-94 05 557.2 describes a wooden barrier that uses, as rails, wooden logs longitudinally sawn into two halves, between which is provided a single flat metallic bar, the elemental form of such a reinforcement limiting the increase in weight and cost.

Nevertheless, not only does such a barrier remain relatively heavy and expensive, but the flat metallic bar, under the described conditions of use, presents too low a resistance to fulfill any function other than only maintaining integrity of the rail in case of impact.

Moreover, from the patent document EP 0 924 346 a wooden barrier of the first type mentioned above is known, that is, in which the rails are reinforced by synthetic fibers.

Unlike close material, the barrier described in this document has the same structure as the barrier described in the German utility model DE-G-94 05 557.2, namely that it uses wooden logs longitudinally sawn into two halves as rails, between which is provided a layer of synthetic fibers for reinforcement.

The barrier described in the patent document EP 0 924 346 compared to the barrier of the German utility model DE-G-94 05 557.2 obviously benefits from a reduction in weight and inherent expense by changing the material used. On the other hand, the sheet of fibers can only supply this barrier with still less resistance than that supplied by the flat metallic bar on the barrier of the German utility model DE-G-94 05 557.2.

SUMMARY OF THE INVENTION

In this context, the present invention especially has the goal of proposing a relatively light and less expensive barrier using wooden rails, and in which the rails nevertheless present an increased resistance, effectively making it possible to bring back to the highway any vehicle that has left it.

To this end, in the barrier of the invention at least some of the fibers of a first cover of each rail are glued to the rail and oriented along the longitudinal axis and arranged at a distance from the longitudinal axis of the rail, with greater proximity to the rear external surface than to the front external surface of this rail.

In other words, instead of being arranged on the neutral axis of the rail as in the patent document EP 0 924 346, that is, exactly between the zone in which, in case of impact, the rail undergoes tension and the zone in which it undergoes compression, the fibers organized in conformance with the invention, on the one hand, offer resistance to the tensile stresses that are added to that of the wood and, on the other hand, ensure the cohesion of the wooden fibers over a significant depth, which has the additional effect of increasing the elasticity of the rail in its entirety.

In one production method of the invention, the first cover of fibers of each rail extends in a plane parallel to the horizontal axis and separates the rail into a front part turned toward the highway and a rear part turned toward the posts, the front part being thicker than the rear part.

Preferably, the synthetic fibers used are fibers that have a high mechanical performance and especially present a tensile strength at least twice as great as that of wood.

The synthetic fibers fixed on the rail by gluing are advantageously glued with a resin.

Moreover, the rail advantageously has between the first cover of fibers and its front external surface a circular cross-section or a cross-section with a circular segment such as a semi-circle.

In order to dimensionally stabilize the transverse section of the rail, some of these fibers are advantageously oriented at least along a direction making an angle with the axis of the rail that is not zero.

Preferably, the GSM of the fibers is greater at the level of the fixation zones of the rail on the posts than on the rest of the rail, so as to limit the risks of splintering in the fixation zones where significant forces are locally concentrated, principally around the means for fixation of the rail on the post.

Fibers may be also fixed on the upper part of the rail, exposed to the weather, to increase the durability of the wood.

Moreover, a cut is advantageously made in the lower part of the rail, to free the stresses due to shrinkage of the wood, which is naturally produced in the wood when it dries, and to thus avoid the formation of cracks on the periphery of the rail.

In a preferred method of production, at least part of the fibers is placed on the entire external surface of the rail.

In particular, these fibers may form a tubular fabric added to the wooden rail and then fixed on the latter.

In fact, as the wood of the barriers is normally subjected to the weather and to attacks by destructive organisms like fungi or insects, it must undergo a treatment, especially with metal salts, to increase its durability.

When the barriers are taken down, the wooden rails must be recycled to limit pollution due to metal salts with which the wood is impregnated and which are very toxic.

The expenses brought about by recycling treated wood are very high since they are approximately three times greater than the price of natural wood itself.

Thus, the fact that the only known treatments designed to increase the durability of the wood require the use of polluting substances forms another very important drawback.

This drawback, which moreover exists not only for wood intended for the production of barriers, but also for all wood used outside, such as that used for the construction of fences or even for playgrounds, arranged for example in squares, may thus be eliminated by enclosing the wooden rail in a sleeve of synthetic fibers, in which the fibers adjacent to the rear surface of the rail considerably reinforce the resistance of the latter.

Finally, fibers may be provided, without being fixed, between the wood of the rail and fibers glued to the rail.

The synthetic fibers used may be especially fibers of glass, carbon or Kevlar® or even a mixture of these fibers.

BRIEF DESCRIPTION OF DRAWING FIGURES

The invention will be better understood and other goals, advantages and characteristics of the latter will appear more clearly with reading of the description which follows and which is made with regard to the fixed drawings in which.

DETAILED DESCRIPTION

Figure 2:
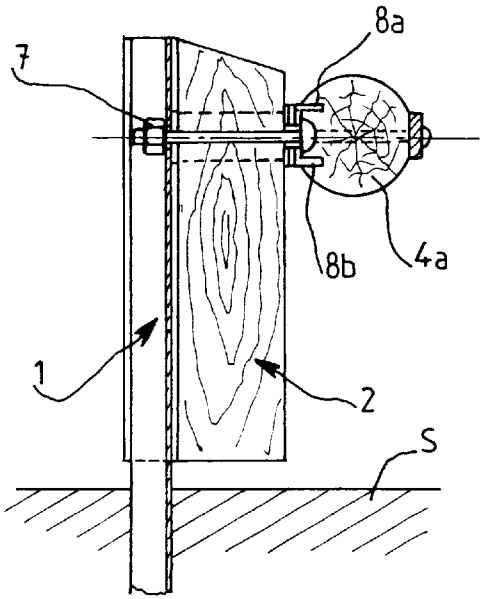
FIG. 2 is a sectional view along II—II of FIG. 1.
Figure 1:
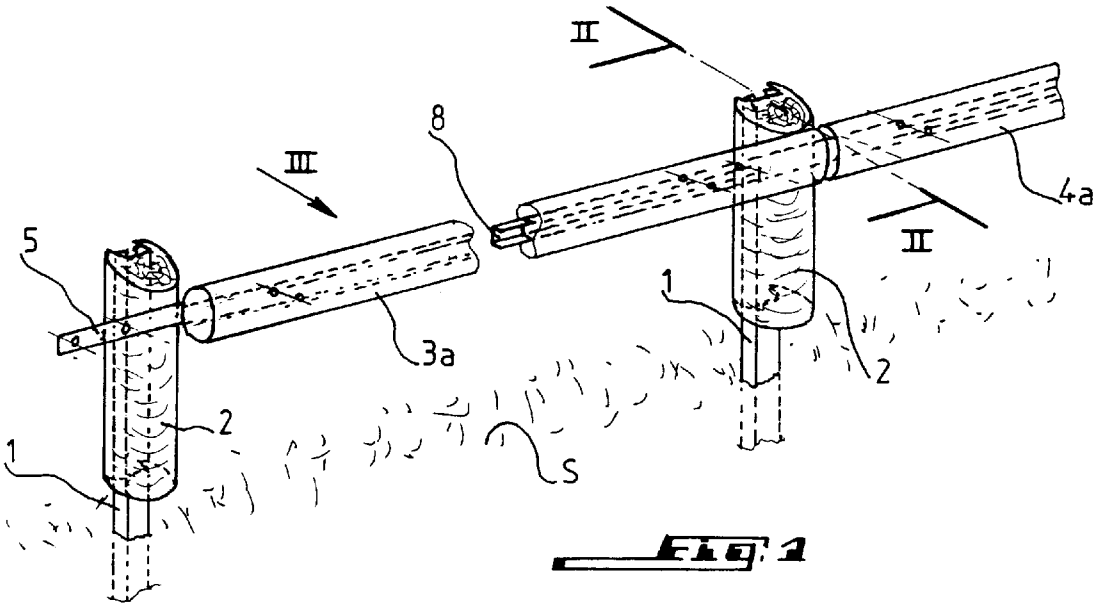
FIG. 1 is a perspective view of a conventional crash barrier composed of wooden rails with metal reinforcement.

First, reference is made to FIGS. 1 and 2 which illustrate a section of a conventional barrier which is composed of metal posts 1, driven into the ground S. Each of them has a wooden spacer 2, here cylindrical in shape. On these spacers 2 are fixed wooden rails 3 and 4 which are combined end to end by any appropriate means and especially with joint bars 5.

Each rail is fixed at each of its ends, to a spacer 2 by any appropriate means and especially a bolt 7.

FIGS. 1 and 2 also show that each wooden rail, cylindrical in section, is cut with two longitudinal slits which receive the two wings 8*a* and 8*b* of a metal section 8.

This section conventionally is used to reinforce the wooden rail to prevent its splitting during impact of a vehicle against the barrier, and guarantee the integrity of the barrier.

Figure 3:
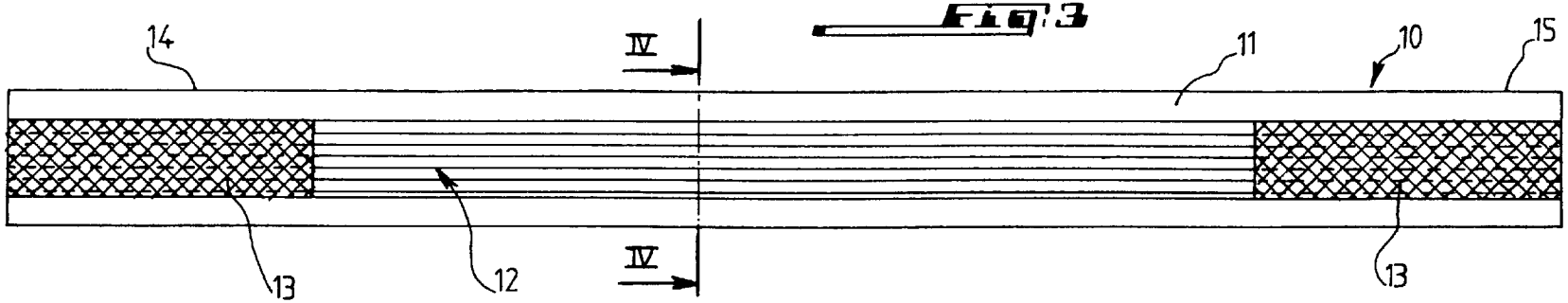
FIG. 3 is a plan view of the rear side of a rail of a barrier according to the invention.
Figure 4:
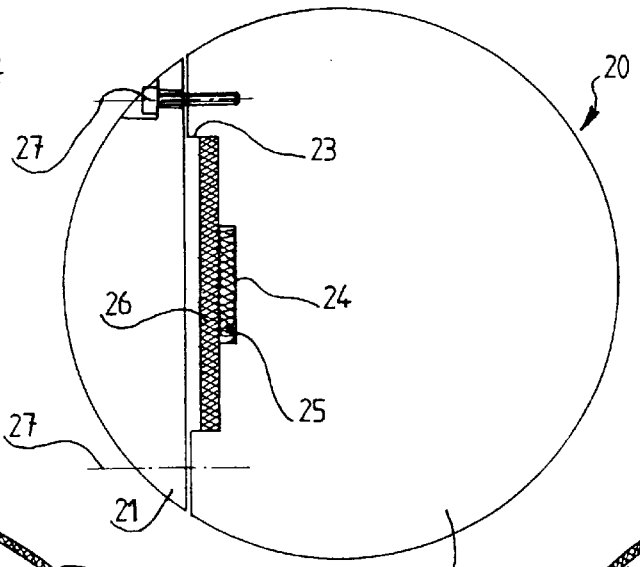
FIG. 4 is a sectional view along IV—IV of FIG. 3 which represents a cross section of the rail.

Reference is now made to FIGS. 3 and 4 which illustrate a wooden rail used in the barrier according to the invention.

In this production example, the rail 10 is semicylindrical. FIG. 3 illustrates this rail viewed from the rear along arrow III shown in FIG. 1, or even from the side of the metal posts 1 or the ravine which runs alongside the highway bordered by the barrier.

FIG. 3 shows that on the rear plane surface 11 of the rail 10 are fixed synthetic fibers 12 which extend down substantially the entire length of the rail 10.

These fibers 12 extend here on part of the rear surface 11 but they could also be fixed on the entire rear surface.

It will also be noted that the synthetic fibers 12 are unidirectional in this example and are oriented in the direction of the wood fibers.

Moreover, at the two end zones 14 and 15 of the rail 10, other synthetic fibers 13 are provided. In this example they are oriented along two directions making an angle of 45° with the direction of fibers 12.

These intertwined fibers 13 are therefore provided at both end zones of the rail, which correspond to the zones of fixation of the rail 10 on the metal posts 1.

The fibers 12, 13 are fixed by gluing on the entire length of the rail, respectively from each end zone gluing, especially by a resin.

In a production example, the fibers 12 are formed from three layers of a unidirectional sheet of glass fibers in which the GSM may vary between 290 g/m$^2$ and 600 g/m$^2$. The sheets of glass fibers sold under the name Vetrotex® with reference numbers UC 290 and UC 600 are suitable for this application.

Moreover, the synthetic fibers 13 for example may consist of two additional layers of a bidirectional sheet of glass fibers, especially sold under the name Vetrotex® with the reference number RT 600.

By way of example, the GSM of the glass fibers may be between 600 and 1000 g/m$^2$ at the assembly zones and between 300 and 600 g/m$^2$ on the rest of the rail, with it understood that the GSM is adapted to the technical requirements which take into account the speed and type of vehicle likely to contact the barrier.

The different layers of fibers may especially be glued, layer by layer, with epoxy glue, especially West System glue, marketed by Wessex Resins & Adhesive Limited.

Other methods of fixation of the fibers may be proposed, with it being understood that some of the fibers are glued to the rail and that the gluing makes it possible to distribute the forces over a large surface, while preventing any concentration of stresses.

The fibers used are not necessarily glass fibers but, generally, synthetic fibers presenting high mechanical performance, that is, mechanical performance much greater than those of wood and at least twice as great as that of wood. It is especially the case with carbon or Kevlar® fibers.

The presence of such synthetic fibers, on the rear of the rail opposite a possible impact (see for example FIG. 4) makes it possible to modify the behavior of the wooden rail. As explained previously, the impact of a vehicle against the barrier at the level of the rail 10 generates impact bending which is itself distorted on the section of the rail, by a tension zone on the side opposite the impact and a compression zone on the side of the impact.

The presence of fibers does not modify the behavior of the wood on the side of the impact, plastic behavior in compression, so the wood absorbs the energy generated by this impact. It is even possible in certain extreme cases for the wood to split under the effect of the impact.

However, the tension generated by the impact on the rear side of the rail causes elastic expansion of the synthetic fibers, which do not break due to their mechanical characteristics. Thus, these are synthetic fibers which ensure the integrity of the barrier in case of impact, a priori as a metal section would do such as section 8 illustrated in FIGS. 1 and 2.

In reality, the barrier according to the invention comprising rails reinforced by fibers behaves better in case of impact than a barrier with rails reinforced with mechanical sections because it proves to be less rigid than a barrier with rails reinforced by metal and it may therefore absorb more energy. Consequently, the car which collides with a barrier according to the invention absorbs less energy and undergoes less damage.

Thus, to ensure the integrity of the barrier in case of impact, it is necessary for the fibers at least in part to be oriented along the axis of the rail or even in the direction of the wood fiber.

The fibers 13 provided at the end zones 14 and 15 of the rail 10 prevent local splitting of the fibers 12. In fact, these end parts of the rail 10 are, in practice, zones of assembly of the rail 10 on the posts 1. This assembly is generally done by bolts such as that numbered 7 in FIG. 2. These bolts concentrate locally significant forces in the direction of the fibers of wood and in the perpendicular direction at the same time. Without transverse reinforcement, these bolts risk making the wooden rail split locally, by cracking between the bolt and the end of the rail. That is why the fibers 13 are advantageously oriented at 45° relative to the direction of the wood fiber.

Except for end parts of the rail 10, fibers other than fibers 12 may be provided which extend in the direction of the wood fibers.

In particular, the unidirectional fibers may be replaced by a bidirectional cloth which then makes it possible to stabilize the section of the rail dimensionally. These sectional deformations may especially be due to drying of the wood and they are encountered most frequently in rails in which the diameter is at least 25 cm.

Reference is more specifically made to FIG. 4 which illustrates a first production variant of a wooden rail of a crash barrier according to the invention.

In this variant, the rail 20 comprises a log with a cylindrical section.

This log is previously sawn into two parts 21 and 22 of different sizes, the sawing being carried out along a plane parallel to the wood fibers, perpendicular to the section of the log.

In the front part 22 with greater size, a cut or a groove 23 is made which also extends in the direction of the wood fibers.

As illustrated in FIG. 4, another cut or groove 24 may also be made in the extension of the cut 23, within the front part 22. This cut 24 also extends in the direction of the wood fibers but presents a height less than that of the cut 23.

In the cut or groove 24, fibers are provided that are not glued to the wood. These fibers may especially be presented in the form of one or more superimposed sheets of fibers, these fibers being preferentially oriented in the direction of the fibers of the wood.

In groove 23 fibers are placed, at least some of which are oriented along the direction of the fibers of wood or even along the longitudinal axis of the rail 20.

As indicated previously, these fibers may especially be presented in the form of several unidirectional sheets of fibers which are successively glued by a resin.

Once the fibers 25, 26 are placed in the grooves 24, 23, respectively, the part 21 of the rail previously sawn is placed on the other part 22 of the rail 20 so as to cover the fibers placed in the notches.

This fixation is carried out by any appropriate means and especially by nails or screws 27.

Thus, the glued fibers 26 fulfill the same function as the fibers 12 illustrated in FIG. 3.

The rail 20 is arranged so that the part 21 and the fibers 25 and 26 are arranged on the side of the metal posts of the barrier and therefore on the side opposite the highway.

In case of impact of a vehicle on the rail 20, the fibers 26 modify the behavior of the wood on the side opposite the impact, while ensuring the integrity of the barrier.

Moreover, the fibers 25, which are not fixed, guarantee a better integrity of the wooden rail in case of impact of a vehicle, especially in the very specific case where the glued synthetic fibers could be broken.

However, the invention is not limited to this production method and glued synthetic fibers 26 only could be provided in the groove 23.

Figure 5:
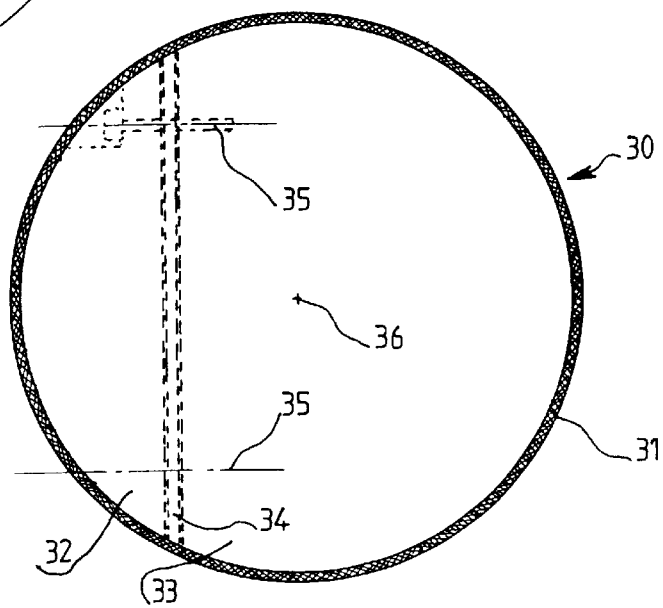
FIG. 5 is a view similar to FIG. 4 illustrating a second production variant of a rail of a barrier according to the invention, with a third production variant illustrated in dotted lines.

FIG. 5 illustrates a second production variant of a rail 30 for a barrier according to the invention.

This rail 30 is made from a wooden log with a cylindrical section.

It includes on its entire external surface synthetic fibers 31 that are fixed at least in part. These fibers are therefore arranged on the entire external part of the section of the rail.

As explained previously, this fixation is carried out preferably by gluing for better distribution of the forces.

In practice, these fibers 31 may be presented in the form of a tubular fabric which is added to the rail 30, then fixed on the latter.

When the fibers 31 are fixed on the entire external surface of the rail 30, this second production variant presents the advantage of avoiding any previous treatment of the wood to increase its durability.

Moreover, this production method reinforces the cohesion of the wood and, in the case of impact of a vehicle against the rail 30, prevents wood debris from being ejected at the point of impact; this debris may be dangerous for passengers in the vehicle.

In a third production variant illustrated in dotted lines in FIG. 5, the rail 30 may be previously cut into two parts with different dimensions 32 and 33, along a longitudinal plane of the rail 30 or even in a plane parallel to the wood fiber.

Synthetic fibers 34 may then be glued on part 33 with the largest dimensions, as explained previously in regard to FIGS. 3 to 5.

Part 32 of the rail with the smallest dimensions is next fixed on part 33 by any appropriate means, and especially with nails or screws 35.

Once these operations have ended, the external surface of the rail 30 may be covered with synthetic fibers 31 which are preferably glued on the entire external surface of the rail.

The presence of fibers 34 makes it possible to reinforce the rail 30 still more.

Figure 6:
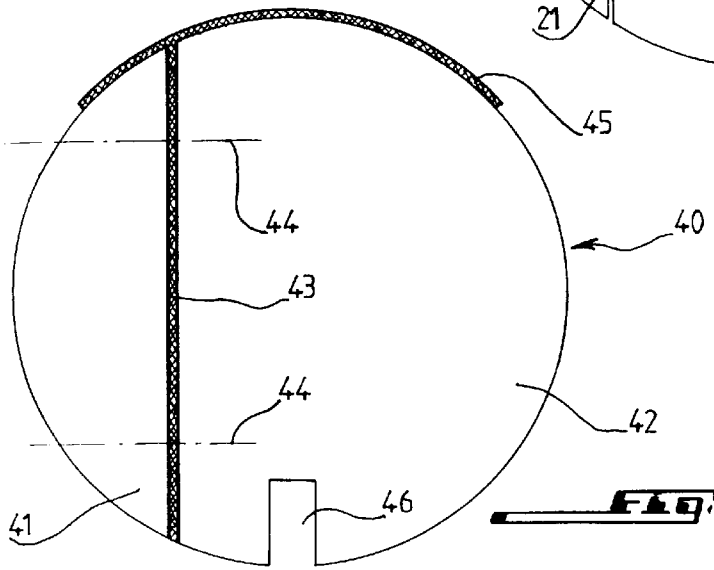
FIG. 6 is a view similar to FIG. 4 illustrating a fourth production variant of a wooden rail of a barrier according to the invention.

FIG. 6 illustrates a fourth production variant of a wooden rail 40 suitable for a barrier according to the invention.

This rail 40 is made from a log with a cylindrical section.

This rail 40 is previously sawn into two parts 41 and 42 with different dimensions, along a longitudinal plane parallel to the wood fibers.

Synthetic fibers 43 are provided and fixed on the internal rear surface of the front part 42, that is, on the rear side opposite the possible impact of a vehicle.

The rear part 41 is next fixed on the first part 42 by any appropriate means 44.

In this production variant, synthetic fibers 45 are also placed in the upper part of the rail 40 intended to be principally subjected to the weather. These synthetic fibers 45 are also fixed by gluing to the upper part of the rail 40.

Moreover, conventionally, a cut 46 may be provided in the lower part of the rail 40. This cut makes it possible to free the internal stresses of drying which are naturally produced during drying of wood.

Thus, the synthetic fibers 43, just as fibers 12 or 26 described previously, make it possible to modify the behavior of the wood in case of impact of a vehicle on the rail 40, while ensuring the integrity of the barrier.

Moreover, the fibers 45 glued on the upper part of the rail 40 make it possible to protect the more exposed upper part of the rail 40 from the weather or any attack of destructive organisms.

Thus, these fibers 45 glued on the upper surface of the rail make it possible to increase the durability of the wood forming the rail 40, without requiring conventional treatment with metal salts, these fibers not necessarily presenting high mechanical performances.

Thus, the two production variants illustrated with FIGS. 5 and 6 enable, as a result of fibers 31, 45, respectively, an increase in the durability of the wood without treatment with polluting products.

In the case where synthetic fibers are provided on the external surface of the wooden rail, a surface treatment such as appropriate painting may be provided to avoid degradation of the fibers and the resin by light. This painting may then form a support for fluorescent material, which is particularly appropriate for crash barriers, for example to indicate more strongly the layout of the highway.

In all the production examples that have just been described, reference was made to sheets of fibers glued to the wood or to another sheet using a resin.

The invention is of course not limited to this production form. One could also provide gluing on one part of the section of the rail with fibers already impregnated with resin and being presented in the form of a preformed lamella, the sheet and the lamella being grouped under the term "cover."

Moreover the GSM of the synthetic fibers arranged on a wooden rail of a barrier according to the invention is chosen according to the proposed applications and especially for impacts that the barrier must be able to support while still remaining intact. It also depends on the nature of the synthetic fibers chosen.

Finally, any section of a wooden rail of a barrier according to the invention may be used. However, it is preferable that the rail presents a rounded section on the side of the highway, like a cylindrical section or semicylindrical section. In fact, sections including ridges such as a square or rectangular section cause a concentration of stresses at the level of these ridges in the case of impact, which has harmful consequences on the vehicle.

Trials have been carried out to show the function of reinforcing with synthetic fibers arranged on the rear of a wooden rail.

The trials were carried out with a wooden rail, formed from a Douglas fir log presenting a cylindrical section with a diameter of 18 cm.

A cut or groove has been formed in the rail on its entire length. Next, three layers of glass fibers were glued successively in this groove and on the entire length of the rail by West System epoxy resin.

The layers of glass fibers used are of the Vetrotex® RT 600 type which are bidirectional with a GSM of 600 g/m$^2$.

The total length of the rail is 4 m, the rail being arranged on two supports 3.71 m apart.

The trials consisted of applying a load varying between 5000 and 35,000 N in the middle of such a rail reinforced by fibers and of measuring the displacement.

Similar trials were carried out with wooden rails formed from a Douglas fir log, also presenting a diameter of 18 cm and a length of 4 m; on the other hand, this log did not include any glued fiber.

These trials have shown that a wooden rail that is not reinforced breaks under a force of 20,000 N.

On the contrary, a rail reinforced with glass fibers presents a plastic characteristic, that is, is deformed without being broken for this same force, and, for higher forces, is deformed very significantly, but without breaking, the invention therefore having the effect of decreasing the fragility of the natural wood.

What is claimed is:

1. A crash barrier for roads, the barrier comprising:

posts driven into the ground and spaced apart from each other;

wooden rails connected end-to-end with each other and fixed on the posts, each rail having a longitudinal axis with wood fibers oriented along the longitudinal axis, a front external surface, and a rear external surface turned towards the posts; and synthetic fibers substantially reinforcing the rails along their length and forming at least a first cover that extends parallel to the longitudinal axis, the synthetic fibers separating the rail into a front part and a rear part that is turned towards the posts, the front part being thicker than the rear part and having a cross section including a circular portion exceeding a semicircle, wherein at least some of the synthetic fibers of the first cover are glued to the rail along the longitudinal axis and arranged at a distance from the longitudinal axis, closer to the rear external surface than to the front external surface.

2. The crash barrier according to claim 1 wherein the synthetic fibers have a tensile strength at least twice as great as that of the wooden rails.

3. The crash barrier according to claim 1 wherein the synthetic fibers are glued to the rail with a resin.

4. The crash barrier according to claim 1 wherein at least some of the synthetic fibers are oriented along at least one direction making an angle with the longitudinal axis of the rail that is not zero.

5. The crash barrier according to claim 1 wherein the synthetic fibers have a GSM greater at the level of zones of fixation of the rail on the posts than elsewhere on the rail.

6. The crash barrier according to claim 1 wherein the synthetic fibers are located at least on an external upper surface of the rail, exposed to weather.

7. The crash barrier according to claim 1 wherein the rails include a slit in a lower part of the rail to free stresses due to cracks.

8. The crash barrier according to claim 1 wherein at least part of the synthetic fibers forms an external layer on all of the surface of the rail.

9. The crash barrier according to claim 8 wherein the synthetic fibers on the external surface of the rail form a tubular fabric, fixed on the rail.

10. The crash barrier according to claim 1 including synthetic fibers not fixed to the rail and located between wood parts of the rail and synthetic fibers that are glued to the rail.

11. The crash barrier according to claim 1 wherein the synthetic fibers are selected from the group consisting of glass, carbon, Kevlar®, and mixtures of these fibers.

12. A crash barrier for roads, the barrier comprising:

posts driven into the ground and spaced apart from each other;

wooden rails connected end-to-end with each other and fixed on the posts, each rail having a longitudinal axis with wood fibers oriented along the longitudinal axis, a front external surface, and a rear external surface turned towards the posts; and synthetic fibers substantially reinforcing the rails along their length and forming at least a first cover that extends parallel to the longitudinal axis, wherein the rail, between the front cover and the front external surface, has a cross section including a circular portion exceeding a semicircle and at least some of the synthetic fibers of the first cover are glued to the rail along the longitudinal axis and arranged at a distance from the longitudinal axis, closer to the rear external surface than to the front external surface.

* * * * *